US005562552A

United States Patent [19]

Thurman

[11] Patent Number: 5,562,552

[45] Date of Patent: Oct. 8, 1996

[54] GEODESIC ICOSAHEDRAL GOLF BALL DIMPLE PATTERN

[75] Inventor: Robert T. Thurman, Humboldt, Tenn.

[73] Assignee: Wilson Sporting Goods Co., Chicago, Ill.

[21] Appl. No.: 301,245

[22] Filed: Sep. 6, 1994

[51] Int. Cl.[6] ..... A63B 37/14

[52] U.S. Cl. ..... 473/379

[58] Field of Search ..... 273/232; 473/378, 473/379

[56] References Cited

U.S. PATENT DOCUMENTS

| | | | |
|---|---|---|---|
| 4,142,727 | 3/1979 | Shaw | 273/232 |
| 4,560,168 | 12/1985 | Aoyama | 273/232 |
| 4,722,529 | 1/1988 | Shaw | 273/232 |
| 4,729,861 | 3/1988 | Lynch | 273/232 |
| 4,765,626 | 8/1988 | Gobush | 273/232 |
| 4,813,677 | 3/1989 | Oka | 273/232 |
| 4,840,381 | 6/1989 | Ihara | 273/232 |
| 4,844,472 | 7/1989 | Ihara | 273/232 |
| 4,867,459 | 9/1989 | Ihara | 273/232 |
| 4,869,512 | 9/1989 | Nomura | 273/232 |
| 4,877,252 | 10/1989 | Shaw | 273/232 |
| 4,915,389 | 4/1990 | Ihara | 273/232 |
| 4,925,193 | 5/1990 | Melvin | 273/232 |
| 4,938,471 | 7/1990 | Nomura | 273/227 |
| 4,946,167 | 8/1990 | Yamada | 273/232 |
| 4,960,282 | 10/1990 | Shaw | 273/232 |
| 4,973,057 | 11/1990 | Morell | 273/232 |
| 4,974,853 | 12/1990 | Morell | 273/232 |
| 4,974,854 | 12/1990 | Morell | 273/232 |
| 4,974,855 | 12/1990 | Morell | 273/232 |
| 4,974,856 | 12/1990 | Morell | 273/232 |
| 4,979,747 | 12/1990 | Jonkouski | 273/232 |
| 4,982,964 | 1/1991 | Morell | 273/232 |
| 4,991,852 | 2/1991 | Pattison | 273/232 |
| 5,009,428 | 4/1991 | Yamagishi | 273/232 |
| 5,016,887 | 5/1991 | Jonkouski | 273/232 |
| 5,024,444 | 6/1991 | Yamagishi | 273/232 |

(List continued on next page.)

FOREIGN PATENT DOCUMENTS

| | | |
|---|---|---|
| 0234081 | 2/1987 | European Pat. Off. . |
| 62-231681 | 10/1987 | Japan . |
| 63-51871 | 3/1988 | Japan . |
| 63-238883 | 10/1988 | Japan . |
| 64-8983 | 1/1989 | Japan . |
| 64-8982 | 1/1989 | Japan . |
| 1-221182 | 9/1989 | Japan . |
| 2-134175 | 5/1990 | Japan . |
| 2-152475 | 6/1990 | Japan . |
| 2-152476 | 6/1990 | Japan . |
| 3-57467 | 3/1991 | Japan . |
| 3-140168 | 6/1991 | Japan . |
| 3-158178 | 7/1991 | Japan . |
| 4-109968 | 4/1992 | Japan . |
| 5-84329 | 4/1993 | Japan . |
| 5-36210 | 5/1993 | Japan . |
| 5-161725 | 6/1993 | Japan . |
| 5-73426 | 10/1993 | Japan . |
| 5-300952 | 11/1993 | Japan . |
| 377354 | 7/1932 | United Kingdom . |
| 2216017 | 4/1989 | United Kingdom . |
| 2211743 | 12/1989 | United Kingdom . |
| 2243555 | 6/1991 | United Kingdom . |

*Primary Examiner*—George J. Marlo

[57] ABSTRACT

A method of laying out a dimple pattern on a golf ball comprises constructing a geodesically expanded icosahedron having 60 equal triangular faces. Each of the 60 triangular faces includes a substantially identical dimple pattern. The geodesic icosahedron is formed by constructing an icosahedron which is circumscribed by a sphere which has the diameter of the golf ball. A point is determined in each of the 20 icosahedral triangles of the icosahedron by bisecting the three sides of the icosahedral triangle. A geodesic focus point is determined by projecting said point onto the surface of the sphere. Each geodesic focus point is connected to each apex of the icosahedral triangle so that each geodesic focus point forms a right regular tetrahedron having a base formed by the icosahedral triangle and three triangular faces which merge at the geodesic focus point.

16 Claims, 6 Drawing Sheets

U.S. PATENT DOCUMENTS

| | | | |
|---|---|---|---|
| 5,033,750 | 7/1991 | Yamagishi | 273/232 |
| 5,046,742 | 9/1991 | Mackey | 273/232 |
| 5,062,644 | 11/1991 | Lee | 273/232 |
| 5,078,402 | 1/1992 | Oka | 273/232 |
| 5,087,048 | 2/1992 | Sun | 273/232 |
| 5,087,049 | 2/1992 | Yamagishi | 273/232 |
| 5,092,604 | 3/1992 | Oka | 273/232 |
| 5,123,652 | 6/1992 | Oka | 273/232 |
| 5,145,180 | 9/1992 | Oka | 273/232 |
| 5,149,100 | 9/1992 | Melvin | 273/232 |
| 5,156,404 | 10/1992 | Oka | 273/232 |
| 5,192,078 | 3/1993 | Woo | 273/232 |
| 5,192,079 | 3/1993 | Sun | 273/232 |
| 5,201,522 | 4/1993 | Pocklington | 273/232 |
| 5,249,804 | 10/1993 | Sanchez | 273/232 |
| 5,253,872 | 10/1993 | Lemmons | 273/232 |
| 5,259,624 | 11/1993 | Puckett | 273/232 |
| 5,301,951 | 4/1994 | Morell | 273/232 |
| 5,308,076 | 5/1994 | Sun | 273/232 |
| 5,415,410 | 5/1995 | Aoyama | 273/232 |

GEODESIC ICOSAHEDRAL GOLF BALL DIMPLE PATTERN

BACKGROUND AND SUMMARY

This invention relates to golf ball dimple patterns, and, more particularly, to a golf ball dimple pattern which is constructed on a geodesically expanded icosahedron.

In order to provide golf balls with symmetrical, repeatable flight performance, dimple patterns have been developed using spherical projections of polyhedrons, e.g., octahedrons, dodecahedrons, icosahedrons, etc. The dimples are arranged so that the dimple pattern within each polyhedron is the same or substantially the same. Higher numbers of faces or sides on the polyhedron represent higher levels of repeatability. The icosahedron, i.e., a polyhedron with 20 triangular faces, is the most commonly used polyhedron and provides a golf ball with a dimple pattern which has repeating elements composed of 20 spherical triangles.

U.S. Pat. No. 4,560,168 describes an icosahedral dimple pattern. The dimples are positioned within the spherical icosahedral triangles so that the dimples do not intersect the six great circles which pass through the midpoints of the sides of the triangles. The mold parting line can be aligned with one of the great circles, and the other great circles provide false parting lines which increase the symmetry of the pattern.

U.S. Pat. No. 4,142,227 describes a dodecahedral dimple pattern which includes 10 great circles which do not intersect dimples. However, the surface of the ball includes from 12 to 30 rectangular bald patches or dimple-free areas.

The United States Golf Association (USGA) tests golf balls in accordance with a USGA symmetry test. A golf ball is hit by an automatic swinging machine so that it spins about one axis and is then hit so that it spins about an axis which is perpendicular to the first axis. The differences between the two hits should not exceed a certain distance if the ball is symmetrical. If the number of exact repeating elements could be increased, then a dimple pattern could be created with improved symmetry and flight performance repeatability.

British Patent No. 377,354 describes an icosahedral dimple pattern. In FIG. 5 each icosahedral spherical triangle is divided into six right spherical triangles. FIG. 5 does not make any provision for a parting line, and the pattern would be assymetrical at the parting line.

U.S. Pat. No. 4,915,389 also illustrates an icosahedral dimple pattern in which each icosahedral triangle is divided into six right triangles. The pattern does not have any parting line, and the dimples are arranged on all great circles. A spherical surface is formed by a centerless grinding machine, and the dimples are machined into the surface.

U.S. Patent No. 5,192,078 also illustrates an icosahedral dimple pattern in which each icosahedral triangle is divided into six right triangles. Dimples which intersect the mold parting line are removed and replaced with semi-circular or other aerodynamically equivalent dimples which do not intersect the parting line. The pattern might achieve aerodynamic symmetry, but it does not achieve geometric symmetry.

U.S. Pat. No. 5,249,804 describes another icosahedral dimple pattern in which the icosahedral triangles are divided into six right triangles. The parting line is generally saw-tooth-shaped and passes back and forth across an equator of the ball.

SUMMARY OF THE INVENTION

I have found that a higher level of repeatability can be obtained by using a geodesically expanded icosahedron for providing repeating elements over that provided by a spherical icosahedron. An icosahedron is expanded geodesically by forming a regular icosahedron which is circumscribed by a sphere having the diameter of the golf ball. The sphere intersects each of the apices of the icosahedron. The point on each triangular face of the icosahedron which is formed by the intersection of the bisectors of each side of the triangle is projected onto the spherical surface to obtain the geodesic focus point. Using the geodesic focus point, a right regular tetrahedron is constructed on each triangular face by connecting line segments between the focus point and each apex of the triangular face. The base of each regular tetrahedron is formed by a triangular face of the icosahedron, and the three faces of the tetrahedron merge at the focus point. The three faces of the 20 tetrahedrons provide 60 repeating spherical triangles, which is three times more repeatable than a standard icosahedral pattern. The dimples are arranged so that each of the 60 triangles have the same or substantially the same dimple pattern.

DESCRIPTION OF THE DRAWING

The invention will be explained in conjunction with illustrative embodiments shown in the accompanying drawing, in which.

DESCRIPTION OF SPECIFIC EMBODIMENTS

Figure 1:
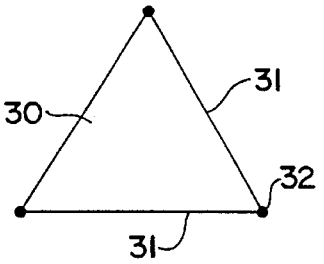
FIG. 1 is a top plan view of one of the triangular faces of an icosahedron.
Figure 2:
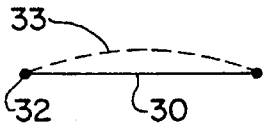
FIG. 2 is a side view of the face of the icosahedron, with a circumscribing spherical surface shown in dotted outline.

FIGS. 1 and 2 illustrate the prior art approach of projecting one of the triangular faces of a regular icosahedron onto a spherical surface to form a spherical icosahedral triangle. FIG. 1 is a top plan view of a flat icosahedral triangle 30 having three sides 31 and three apices 32. FIG. 2 is a side elevational view of the flat icosahedral triangle. The spherical surface 33 which circumscribes the icosahedron intersects the three apices 32. The projection of the flat triangle 30 onto the spherical surface forms a spherical triangle.

Figure 3:
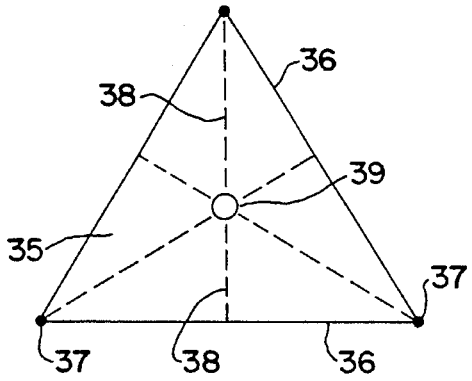
FIG. 3 is a top plan view of one of the triangular faces of an icosahedron showing the intersection of the bisectors of the sides.
Figure 4:
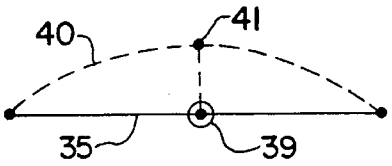
FIG. 4 is a side view similar to FIG. 2 showing the projection of the intersection of the bisectors onto the spherical surface to determine the geodesic focus point.

FIGS. 3 and 4 illustrate the method of forming a geodesic icosahedron. A flat icosahedral triangle 35 has three sides 36 and three apices 37. Each of the sides is bisected by a line 38 which is perpendicular to the side. The bisectors intersect at a point 39. FIG. 4 illustrates the projection of the point 39 onto a spherical surface 40 which circumscribes the icosahedron to define a geodesic focus point 41.

Figure 5:
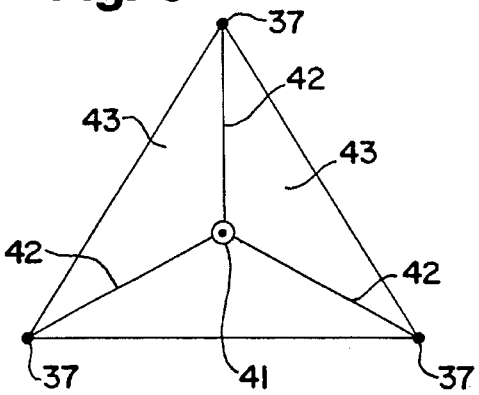
FIG. 5 is a top plan view of a regular tetrahedron constructed on top of the triangular face of the icosahedron.
Figure 6:
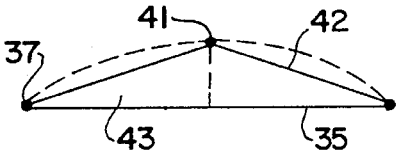
FIG. 6 is a side view of the tetrahedron of FIG. 5.

FIGS. 5 and 6 illustrate using the geodesic focus point 41 to construct a right regular tetrahedron. Three line segments 42 connect the geodesic focus point 41 with each of the apices 37 to form three triangular faces 43 which merge at the geodesic focus point 41. The base of the tetrahedron is the face of the icosahedral triangle 35.

Figure 7:
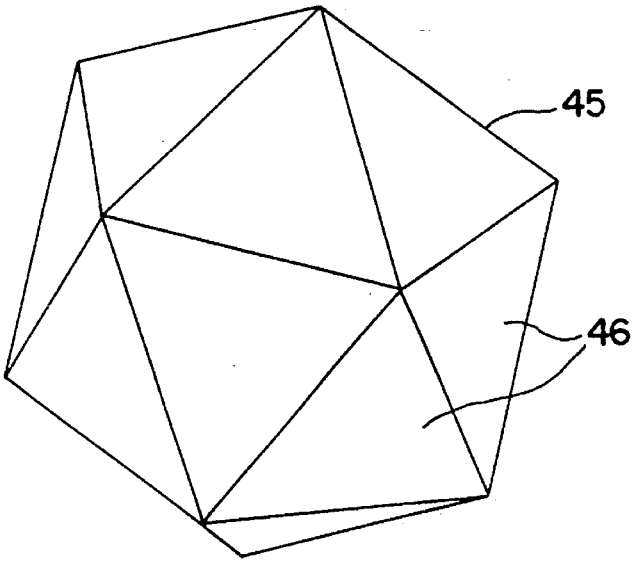
FIG. 7 is a perspective view of an icosahedron.
Figure 8:
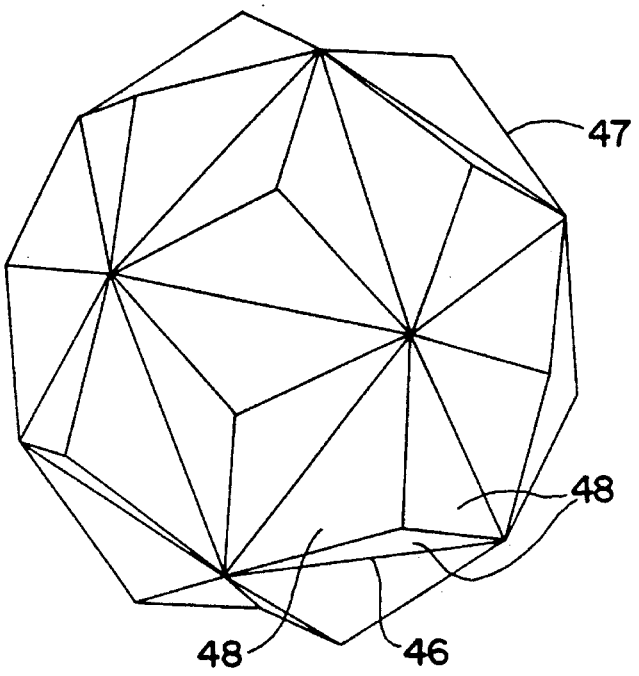
FIG. 8 is a perspective view of a geodesically expanded icosahedron.

FIG. 7 illustrates a regular icosahedron 45 which has 20 flat triangular faces 46. FIG. 8 illustrates a geodesic icosahedron 47 which has three triangular faces 48 mounted on top of each of the icosahedral triangles 46. Each of the triangular faces 48 is an exact repeating element, and there are 60 of those repeating elements on the geodesic icosahedron.

Figure 9:
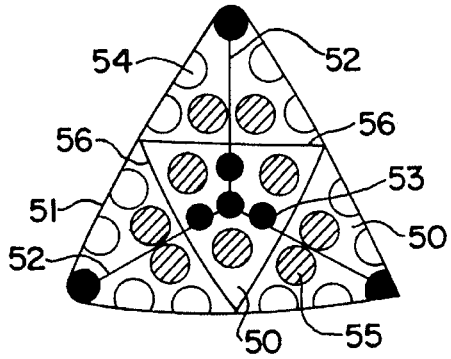
FIG. 9 is a top view of one of the tetrahedrons of a geodesically expanded icosahedron for a dimple pattern having 392 dimples.

FIG. 9 illustrates how the geodesic icosahedron can be used to lay out a symmetrical dimple pattern having 392 dimples. Each tetrahedron of the geodesic icosahedron includes three triangular faces 50. Each triangle includes a base line 51 and a pair of side lines 52 which intersect at the geodesic focus point. The solid dimples 53 are intersected by the sides 52, and the clear dimples 54 are intersected by the base lines 51. The crosshatched dimples 55 are not intersected by either the base or the sides. Each of the triangles 50 includes three whole dimples, six one-half dimples, one one-third dimple at the geodesic focal point, and two one-tenth dimples at the intersection of the base and each side. The total number of dimples for 60 of the triangles is 392. The dimples on the triangular faces 50 are projected onto the spherical surface which circumscribes the geodesic icosahedron to define the locations of the dimples on the spherical surface.

If desired, the dimples can be arranged in accordance with U.S. Pat. No. 4,560,168 to provide six great circles which do not intersect dimples. One of the great circles can be used as the mold parting line. The three base lines 51 form one of the icosahedral triangles, and the line segments 56 which join the midpoints of the sides of the icosahedral triangles form segments of great circles when they are projected onto the spherical surface. There are a total of six such great circles on the sphere. The dimples can be arranged so that they do not intersect the great circle segments. If desired, some slight intersections can be permitted on the great circles which do not form the actual mold parting line.

Figure 10:
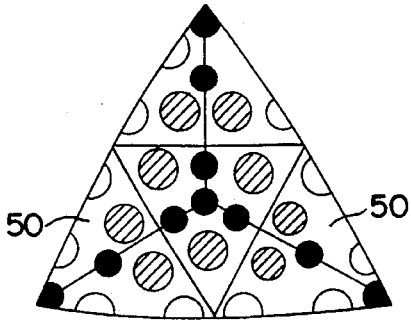
FIG. 10 is a top view of one of the tetrahedrons of a geodesically expanded icosahedron for a dimple pattern having 452 dimples.

FIG. 10 illustrates a dimple pattern having 452 dimples. Each of the triangles 50 includes three full dimples, eight one-half dimples, one one-third dimple, and two one-tenth dimples.

Figure 11:
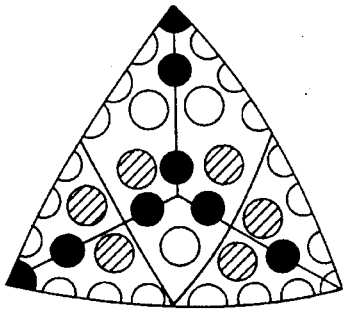
FIG. 11 is a top view of one of the tetrahedrons of a geodesically expanded icosahedron for a dimple pattern having 492 dimples.

FIG. 11 illustrates a dimple pattern having 492 dimples. Each of the triangles 50 includes three full dimples, ten one-half dimples, and two one-tenth dimples.

Figure 12:
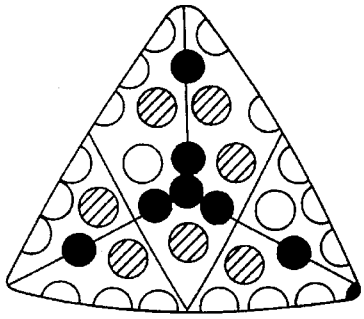
FIG. 12 is a top view of one of the tetrahedrons of a geodesically expanded icosahedron for a dimple pattern having 500 dimples.

FIG. 12 illustrates a dimple pattern having 500 dimples. Each of the triangles 50 includes three full dimples, ten one-half dimples, and one one-third dimple.

Figure 13:
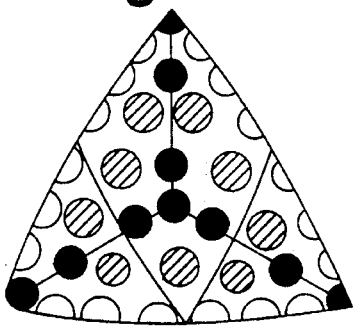
FIG. 13 is a top view of one of the tetrahedrons of a geodesically expanded icosahedron for a dimple pattern having 512 dimples.

FIG. 13 illustrates a dimple pattern having 512 dimples. Each of the triangles 50 includes three full dimples, ten one-half dimples, one one-third dimple, and two one-tenth dimples.

Figure 14:
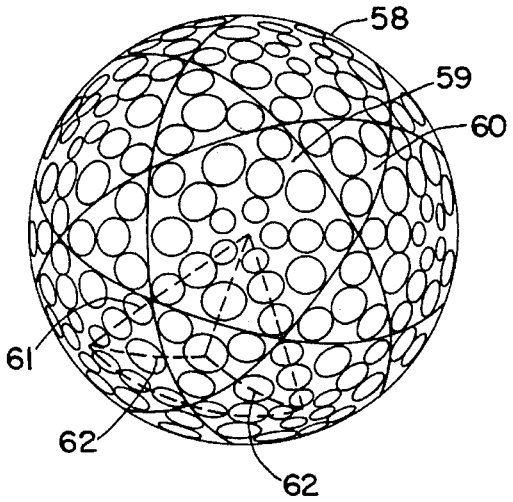
FIG. 14 is a polar view of a golf ball having a geodesically expanded icosahedral dimple pattern with 320 dimples.

FIG. 14 is a spherical illustration of a golf ball 58 with 320 dimples. The solid lines represent the six great circles which pass through the midpoints of the sides of the spherical icosahedral triangles. The great circles form 12 pentagons 59 and 20 small triangles 60, sometimes referred to as an icosadodecahedron. The center of each pentagon is a pole or an apex where five icosahedral triangles meet. The dashed lines 61 are the base lines for one of the tetrahedrons, and the dashed lines 62 form the sides of the three triangular faces of the tetrahedron. Each of the three triangles includes one full dimple, eight one-half dimples, and one one-third dimple.

Figure 15:
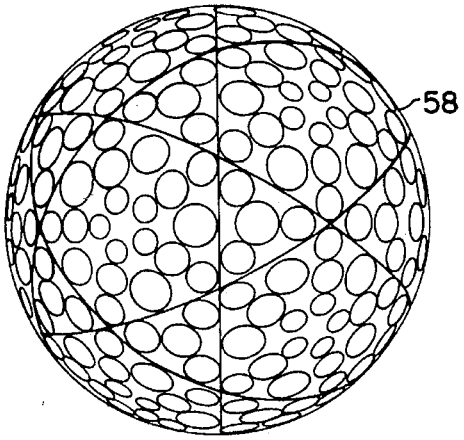
FIG. 15 shows the golf ball of FIG. 14 with one of the great circles of the golf ball extending vertically.

FIG. 14 is a polar view of the golf ball 58. FIG. 15 is an auxiliary view in which the ball is rotated so that one of the great circles extends vertically.

Figure 16:
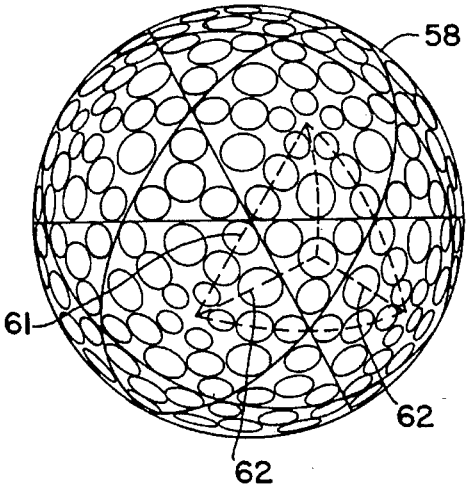
FIG. 16 is a view of the golf ball of FIG. 14 with one of the great circles of the golf ball extending horizontally.
Figure 17:
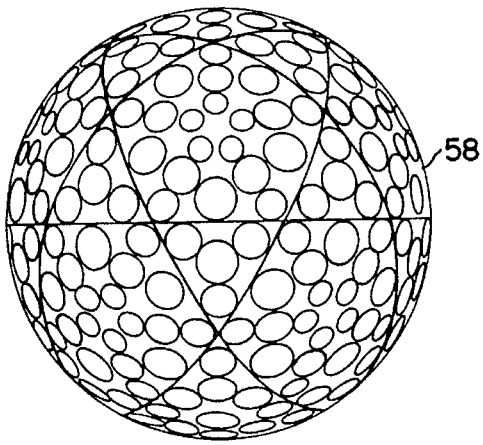
FIG. 17 shows the golf ball of FIG. 16 in a slightly different position.

FIGS. 16 and 17 are alternate views of the golf ball 58 in which one of the great circles forms the equator of the ball.

Figure 18:
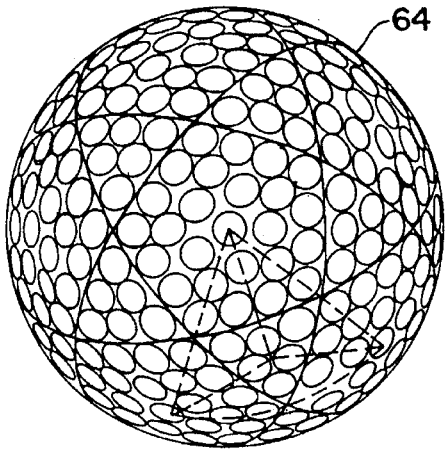
FIG. 18 is a polar view of a golf ball having a geodesic icosahedral dimple pattern with 432 dimples.

FIG. 18 illustrates a golf ball 64 having 432 dimples. Each of the triangles formed by the dashed lines 61 and 62 includes three full dimples, eight one-half dimples, and two one-tenth dimples.

Figure 19:
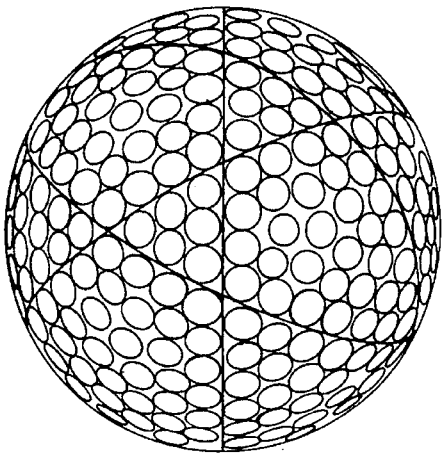
FIG. 19 shows the golf ball of FIG. 18 with one of the great circles of the golf ball extending vertically.
Figure 20:
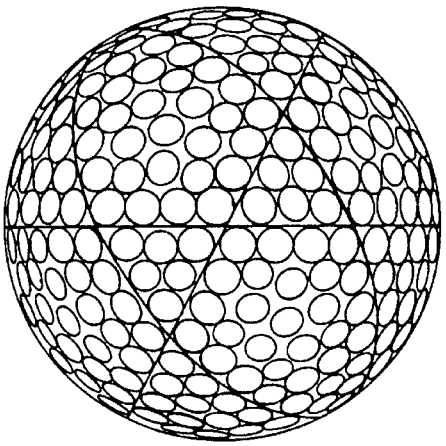
FIG. 20 is a view of the golf ball of FIG. 18 with one of the great circles of the golf ball extending horizontally.
Figure 21:
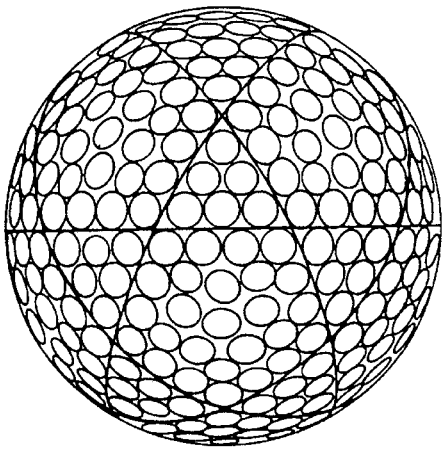
FIG. 21 shows the golf ball of FIG. 20 in a slightly different position.

FIGS. 19–21 are alternate views of the golf ball 64.

Figure 22:
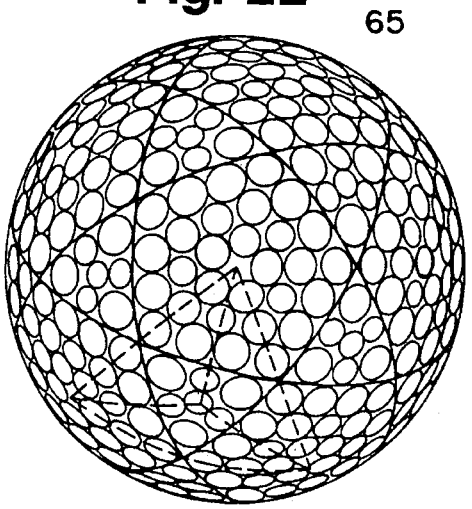
FIG. 22 is a polar view of a golf ball having a geodesic icosahedral dimple pattern with 500 dimples.

FIG. 22 illustrates a golf ball 65 having 500 dimples. The dimple pattern is the same as the pattern illustrated in FIG. 12.

Figure 23:
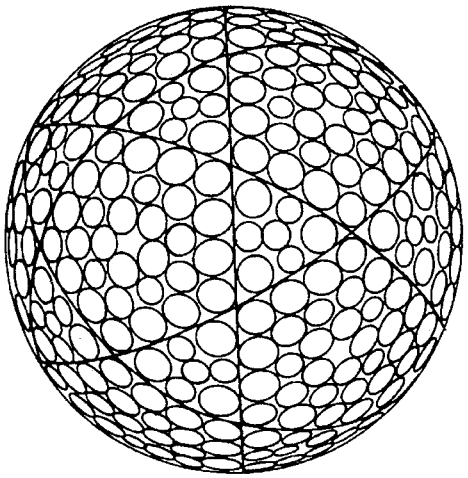
FIG. 23 shows the golf ball of FIG. 22 with one of the great circles of the golf ball extending vertically.
Figure 24:
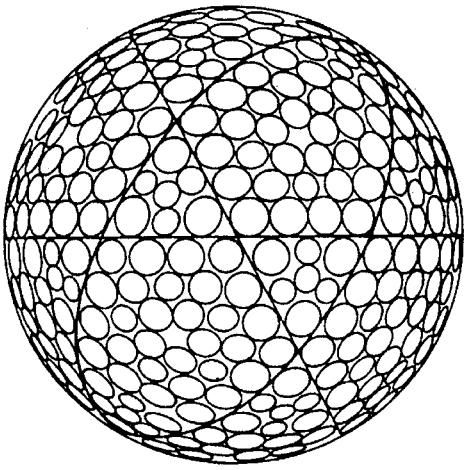
FIG. 24 is a view of the golf ball of FIG. 22 with one of the great circles of the golf ball extending horizontally.
Figure 25:
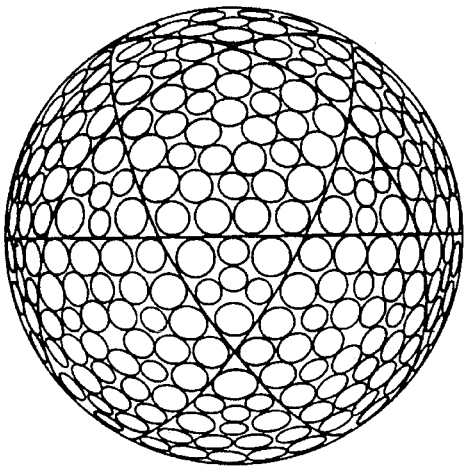
FIG. 25 shows the golf ball of FIG. 24 in a slightly different position.

FIGS. 23–25 are alternate views of the golf ball 65.

Other dimple patterns can be designed with greater or fewer numbers of dimples. In general, about 65 to 85% of the surface of the ball would be covered with dimples, and the dimples are spaced substantially uniformly with no overlapping. Different sized dimples could be used to achieve optimization of flight performance, and the cross sectional geometry of the dimples could be spherical, truncated cone, hexagonal, or other shape, or any combination thereof. The chords or diameters of the dimples generally range from about 0.075 to about 0.200 inch.

While in the foregoing specification, a detailed description of specific embodiments of the invention were set forth for the purpose of illustration, it will be understood that many of the details herein given may be varied considerably by those skilled in the art without departing from the spirit and scope of the invention.

I claim:

1. A method of laying out a dimple pattern on a golf ball comprising the steps of:

a) constructing an icosahedron having 20 icosahedral triangles which is circumscribed by a sphere which has the diameter of the golf ball so that each apex of the icosahedron is intersected by the sphere, b) determining the point on an icosahedral triangle which is intersected by the lines which bisect each side of the icosahedral triangles, c) projecting said point onto the sphere to determine a geodesic focus point for the icosahedral triangle, d) connecting the geodesic focus point to each apex of the icosahedral triangle by a line segment so that the line segments and the sides of the icosahedral triangle form a right regular tetrahedron having a base formed by the icosahedral triangle and three triangular faces which merge at the geodesic focus point and which are in three different planes, e) repeating steps b through d for each of the icosahedral triangles to form a geodesically expanded icosahedron which has 60 of said triangular faces, f) laying out a substantially identical dimple pattern in each of said 60 triangular faces, and g) projecting the dimple pattern of said 60 triangular faces onto the sphere.

2. The method of claim 1 including the steps of connecting the midpoints of each of the sides of each icosahedral triangle by connecting lines, projecting the connecting lines onto the sphere so that each connecting line forms a segment of a great circle on the sphere, and arranging the dimples so that none of the dimples substantially intersects the segments of great circles.

3. The method of claim 1 in which each of the 60 triangular faces includes one full dimple, eight one-half dimples, and one one-third dimple.

4. The method of claim 1 in which each of the 60 triangular faces includes three full dimples, six one-half dimples, one one-third dimple, and two one-tenth dimples.

5. The method of claim 1 in which each of the 60 triangular faces includes three full dimples, eight one-half dimples, and two one-tenth dimples.

6. The method of claim 1 in which each of the 60 triangular faces includes three full dimples, eight one-half dimples, one one-third dimple, and two one-tenth dimples.

7. The method of claim 1 in which each of the 60 triangular faces includes three full dimples, ten one-half dimples, and one one-third dimple.

8. The method of claim 1 in which each of the 60 triangular faces includes three full dimples, ten one-half dimples, one one-third dimple, and two one-tenth dimples.

9. A pattern for forming dimples on a golf ball comprising:

a geodesically expanded icosahedron which has 60 triangular faces and overlies an icosahedron having 20 icosahedral triangles, three of said 60 triangular faces overlying each of said 20 icosahedral triangles to form 20 right regular tetrahedrons having bases formed by the 20 icosahedral triangles, and a spherical surface circumscribing said 60 triangular faces to form a sphere having the diameter of a golf ball with each apex of the icosahedron being intersected by the sphere, whereby a constant dimple pattern can be laid out in each of said 60 triangular faces and then projected onto said spherical surface to form a substantially symmetrical dimple pattern on said spherical surface.

10. The pattern of claim 9 in which the midpoints of each of the sides of each icosahedral triangle are connected by connecting lines, the connecting lines are projected onto the spherical surface and each form segments of great circles on the spherical surface, and the dimples are arranged so that none of the dimples substantially intersects the great circles.

11. The pattern of claim 9 in which each of the 60 triangular faces includes one full dimple, eight one-half dimples, and one-third dimple.

12. The pattern of claim 9 in which each of the 60 triangular faces includes three full dimples, six one-half dimples, one on-third dimple, and two one-tenth dimples.

13. The pattern of claim 9 in which each of the 60 triangular faces includes three full dimples, eight one-half dimples, and two one-tenth dimples.

14. The pattern of claim 9 in which each of the 60 triangular faces includes three full dimples, eight one-half dimples, one one-third dimple, and two one-tenth dimples.

15. The pattern of claim 9 in which each of the 60 triangular faces includes three full dimples, ten one-half dimples, and one one-third dimple.

16. The pattern of claim 9 in which each of the 60 triangular faces includes three full dimples, ten one-half dimples, one one-third dimple, and two one-tenth dimples.

* * * * *

UNITED STATES PATENT AND TRADEMARK OFFICE

CERTIFICATE OF CORRECTION

PATENT NO. : 5,562,552

DATED : October 8, 1996

INVENTOR(S) : Robert T. Thurman

It is certified that error appears in the above-indentified patent and that said Letters Patent is hereby corrected as shown below:

Col. 6, line 37 change "on-third" to --one-third--.

Signed and Sealed this

Seventeenth Day of December, 1996

*Attest:*

*Attesting Officer*

BRUCE LEHMAN

*Commissioner of Patents and Trademarks*